US009080526B2

(12) United States Patent
Santoso et al.

(10) Patent No.: US 9,080,526 B2
(45) Date of Patent: Jul. 14, 2015

(54) AUTO-IGNITION MITIGATION SYSTEM

(75) Inventors: Halim G. Santoso, Novi, MI (US); Stuart R. Smith, Howell, MI (US); James R. Yurgil, Livonia, MI (US)

(73) Assignee: GM Global Technology Operations LLC

( * ) Notice: Subject to any disclaimer, the term of this patent is extended or adjusted under 35 U.S.C. 154(b) by 1003 days.

(21) Appl. No.: 13/156,674

(22) Filed: Jun. 9, 2011

(65) Prior Publication Data

US 2012/0312277 A1 Dec. 13, 2012

(51) Int. Cl.

| | |
|---|---|
| ***F02M 7/00*** | (2006.01) |
| ***F02D 41/06*** | (2006.01) |
| ***F02N 19/00*** | (2010.01) |
| ***F02N 99/00*** | (2010.01) |
| ***F02D 17/04*** | (2006.01) |
| *F02D 41/04* | (2006.01) |
| *F02B 75/12* | (2006.01) |

(52) U.S. Cl.

CPC ..... *F02D 41/062* (2013.01); *F02D 17/04* (2013.01); *F02N 19/005* (2013.01); *F02N 99/006* (2013.01); *F02B 2075/125* (2013.01); *F02D 41/042* (2013.01)

(58) Field of Classification Search

CPC ..... F02D 41/062; F02D 2200/0414; F02N 99/006

USPC ..... 123/179.14, 179.15, 179.3, 179.4, 434, 123/435, 491, 179.1, 406.45, 406.47; 701/102, 103, 104, 112, 113

See application file for complete search history.

(56) References Cited

U.S. PATENT DOCUMENTS

| | | | | |
|---|---|---|---|---|
| 2003/0051692 | A1* | 3/2003 | Mizutani | 123/179.15 |
| 2005/0066943 | A1* | 3/2005 | Tanaka et al. | 123/491 |
| 2007/0039582 | A1* | 2/2007 | Laubender | 123/179.15 |
| 2007/0039594 | A1* | 2/2007 | Konagai et al. | 123/491 |
| 2008/0154484 | A1* | 6/2008 | Takeyama et al. | 701/113 |

FOREIGN PATENT DOCUMENTS

| | | | |
|---|---|---|---|
| CN | 101061300 | A | 10/2007 |

* cited by examiner

*Primary Examiner* — Mahmoud Gimie
*Assistant Examiner* — Sizo Vilakazi

(57) ABSTRACT

An auto ignition mitigation system comprises a piston position module that determines a position of a piston within a cylinder and a temperature module that determines a first temperature of air within the cylinder. A fuel enrichment module communicates with the piston position module and the temperature module and determines a first fuel quantity based on the first temperature and the position of the piston. A fuel control module communicates with the fuel enrichment module and provides the first fuel quantity to the cylinder after the engine is started and before a first exhaust stroke of the piston.

14 Claims, 3 Drawing Sheets

AUTO-IGNITION MITIGATION SYSTEM

FIELD

The present disclosure relates to mitigation of auto-ignition during engine restart.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. When a vehicle is shut off, one or more cylinders may contain a hot air charge. This hot air charge may cause auto-ignition on the first combustion event during a hot restart. Auto-ignition occurs when combustion begins during a compression stroke of the piston before a spark event.

SUMMARY

An auto ignition mitigation system comprises a piston position module that determines a position of a piston within a cylinder and a temperature module that determines a first temperature of air within the cylinder. A fuel enrichment module communicates with the piston position module and the temperature module and determines a first fuel quantity based on the first temperature and the position of the piston. A fuel control module communicates with the fuel enrichment module and provides the first fuel quantity to the cylinder after the engine is started and before a first exhaust stroke of the piston.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The drawings described herein are for illustrative purposes only of selected embodiments and not all possible implementations, and are not intended to limit the scope of the present disclosure. The present disclosure will become more fully understood from the detailed description and the accompanying drawings, wherein.

Corresponding reference numerals indicate corresponding parts throughout the several views of the drawings.

DETAILED DESCRIPTION

Figure 1:
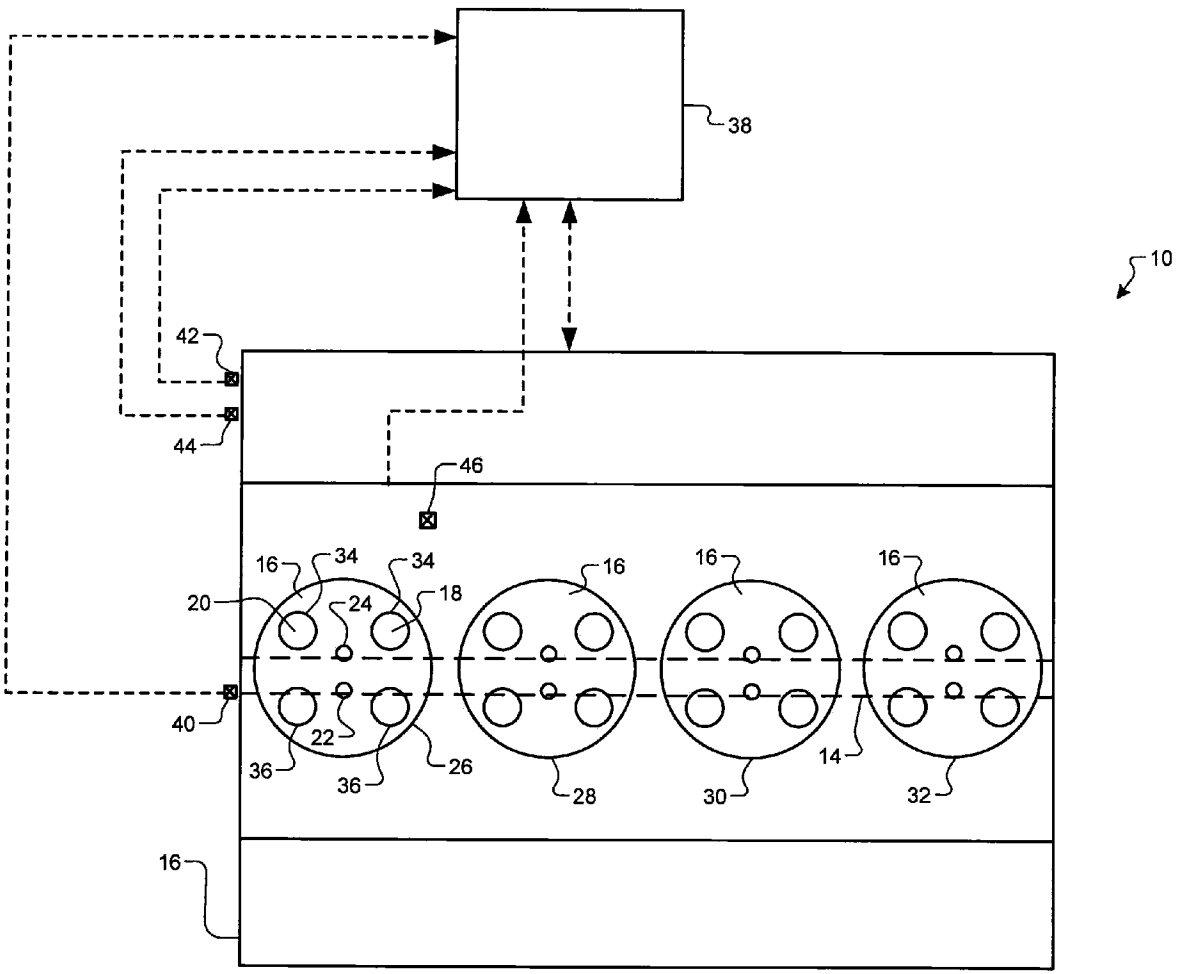
FIG. 1 is a schematic illustration of an engine assembly according to the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Referring to FIG. 1, an exemplary engine 10 is schematically illustrated. The engine 10 may include a crankshaft 14, pistons 16, intake valves 18, exhaust valves 20, spark plugs 22, and fuel injectors 24. The present disclosure is illustrated in combination with an inline four cylinder arrangement for simplicity. However, it is understood that the present disclosure applies equally to any number of piston-cylinder arrangements, as well as a variety of engine configurations including, but not limited to, inline, V-configuration and horizontally opposed arrangements.

The engine 10 includes an engine block defining cylinders 26, 28, 30, 32 and a cylinder head defining intake ports 34 and exhaust ports 36. The pistons 16 are located in the cylinders 26, 28, 30, 32 and engaged with the crankshaft 14. The intake valves 18 are located in the intake ports 34 and the exhaust valves 20 are located in the exhaust ports 36. The spark plugs 22 and fuel injectors 24 are in communication with the cylinders 26, 28, 30, 32. In the present non-limiting example, the fuel injectors 24 are in direct communication with the cylinders 26, 28, 30, 32, forming a direct injection arrangement. However, it is understood that the present disclosure is not limited to direct injection applications and may also apply to port injection arrangements.

The engine 10 may include an auto-start/stop system that increases the fuel efficiency of the vehicle. The auto-start/stop system increases fuel efficiency by selectively shutting down the engine while the vehicle is running. The auto-start/stop system includes a control module 38 which selectively initiates auto-stop events and auto-start events of the engine 10. An auto-stop event includes shutting down the engine 10 when one or more predetermined enabling criteria are satisfied when vehicle shutdown has not been commanded (e.g., while the ignition key is in an on position). During an auto-stop event, the engine 10 is shut down and the provision of fuel to the engine 10 may be disabled, for example, to increase fuel economy (by decreasing fuel consumption). While the engine 10 is shut down during an auto-stop event, the control module 38 selectively initiates an auto-start event. An auto-start event may include, for example, enabling fueling and enabling the provision of spark to start the engine 10.

Additionally, during or at the end of the drive cycle, the engine may be shut down for either an auto-stop event or a key off event. The engine shutdown includes a piston stop event (i.e. where the pistons 16 in the cylinders 26, 28, 30, 32 are stopped). The pistons 16 are stopped when the crankshaft 14 is no longer rotating to cause movement of the pistons 16. The crankshaft 14 may stop rotating in response to either an auto-stop command from the control module 38 or because the driver keyed off the vehicle.

Figure 2:
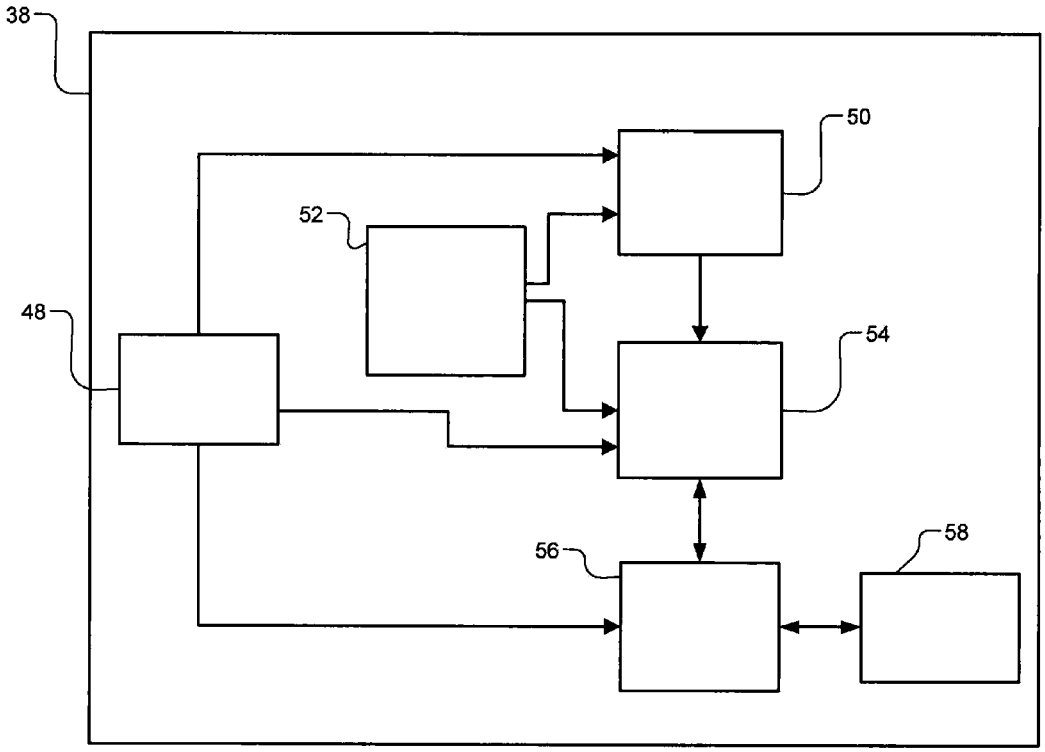
FIG. 2 is a schematic illustration of a control module of the engine assembly of FIG. 1.

The engine 10 further includes a crankshaft position sensor 40, an intake air temperature sensor 42, air flow sensor 44 and engine coolant temperature sensor 46. Referring now to FIG. 2, the control module 38 may form an auto-ignition mitigation system including a piston position module 48, a cylinder volume module 50, a temperature module 52, a fuel enrichment module 54, a fuel control module 56, and an ignition module 58. The crankshaft position sensor 40 is in communication with the piston position module 48 and provides a signal indicating crankshaft position. In the present non-limiting example, the crankshaft position sensor 40 is a bi-directional crankshaft position sensor. The piston position module 48 determines piston position based on a rotational position of the crankshaft 14 provided by the crankshaft position sensor 40.

The intake air temperature sensor 42, the air flow sensor 44 and the engine coolant temperature sensor 46 are each in communication with the temperature module 52. The intake air temperature sensor 42 provides a signal indicating the ambient air temperature. The air flow sensor 44 provides signals indicating the quantity of air flow. The engine coolant temperature sensor 46 provides signals indicating the engine coolant temperature.

The piston position module 48 determines whether one of the pistons 16 located in the cylinders 26, 28, 30, 32 has stopped during a piston intake stroke based on crankshaft position and identifies the corresponding one of the cylinders. The piston position module 48 is in communication with the cylinder volume module 50, the fuel enrichment module 54, and the fuel control module 56 and determines a stopping position of the piston 16. The temperature module 52 is in communication with the cylinder volume module 50 and the fuel enrichment module 54 and determines cylinder air temperature via air flow sensor 44 and engine coolant temperature sensor 46 and ambient air temperature via intake air temperature sensor 42.

The cylinder volume module 50 is in communication with the piston position module 48 and the temperature module 52 and determines cylinder air volume. The cylinder volume module 50 is additionally in communication with the fuel enrichment module 54, which determines a fuel quantity to inhibit auto-ignition based on cylinder air temperature and cylinder air volume. The fuel enrichment module 54 is in communication with the fuel control module 56 and provides the determined fuel quantity to the fuel control module 56. The fuel control module 56 is in communication with the fuel injectors 24 and the ignition module 58. The ignition module 58 is in communication with the spark plugs 22 to command ignition of the fuel quantity provided by the fuel control module 56.

Figure 3:
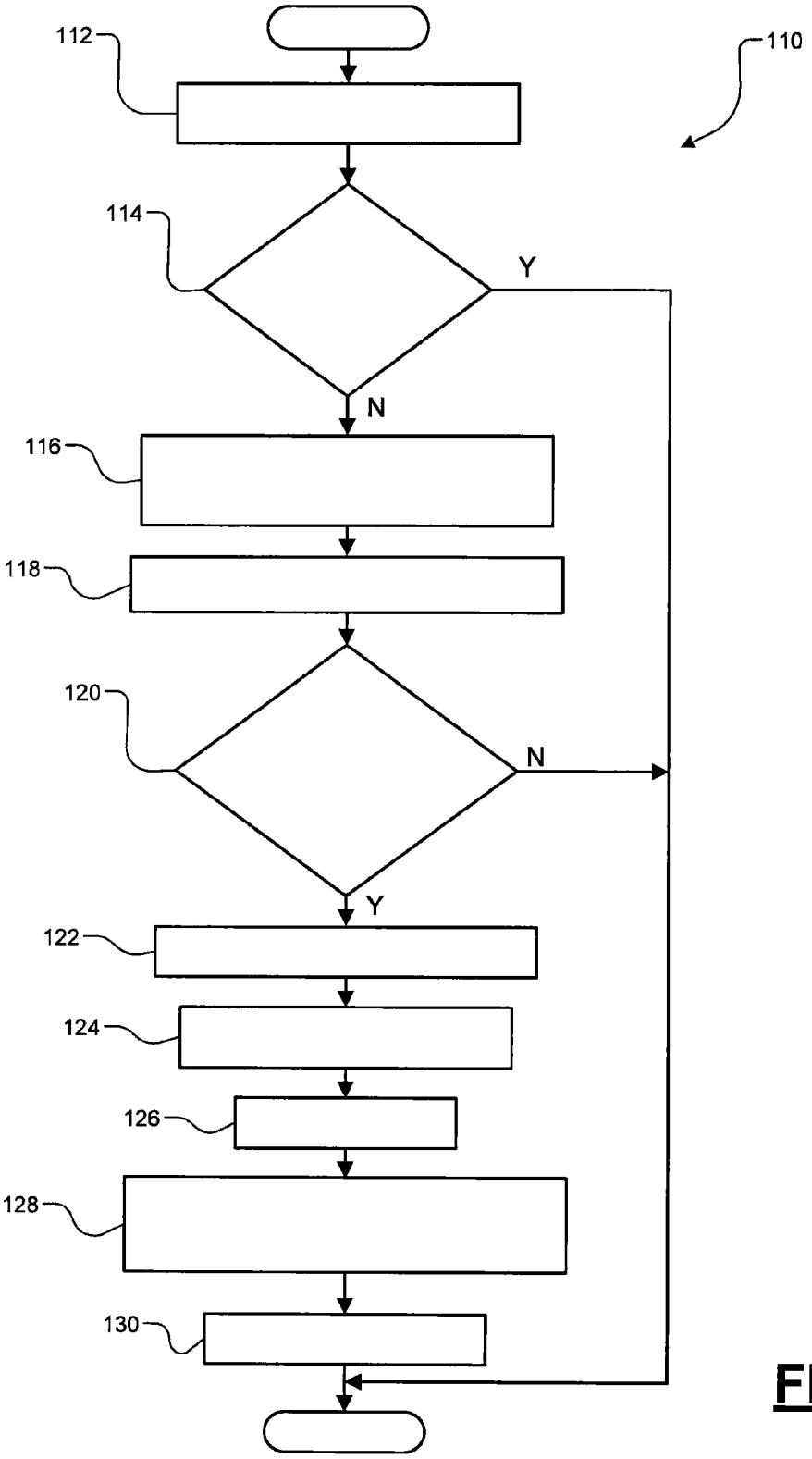
FIG. 3 is an illustration of a flow diagram for operation of the auto-ignition mitigation method.

Referring now to FIG. 3, an auto-ignition mitigation method 110 is illustrated for the auto-ignition mitigation system. The method 110 begins at 112 when the engine 10 is commanded on. The commanded on condition may generally correspond to a key-on condition. An engine-on condition may generally correspond to pistons 16 within the cylinders 26, 28, 30, 32 being driven by combustion events within the cylinders 26, 28, 30, 32. An engine-off condition may generally correspond to the pistons 16 within the cylinders 26, 28, 30, 32 being stationary.

At 114, the method 110 evaluates an elapsed engine-off time immediately prior to the commanded on condition. If the engine-off time exceeds a threshold (e.g., 5 minutes), the method 110 will terminate. Otherwise, the method 110 proceeds to 116. At 116, the method 110 determines which of the cylinders 26, 28, 30, 32 has a piston 16 stopped during the piston intake stroke via the piston position module 48. The cylinder with the piston 16 stopped during the piston intake stroke may also have an intake valve 18 in an open position. Therefore, at 116, the method 110 may additionally determine which of the cylinders 26, 28, 30, 32 has intake valves 18 in an open position. For purposes of illustration, the following discussion will be directed to a condition where the piston 16 is stopped in the first cylinder 26 during the piston intake stroke.

At 118, the temperature module 52 determines the temperature of air within the first cylinder 26. Cylinder air temperature is determined from the surface temperatures of the piston 16 and the first cylinder 26. The temperature module 52 receives signals from the air flow sensor 44 and engine coolant temperature sensor 46, inputs the signals into a mathematical model along with engine speed, and calculates the predicted surface temperatures of the piston and the cylinder. The temperature module 52 determines the cylinder air temperature by looking up the piston and cylinder surface temperatures in a table of predetermined cylinder air temperatures.

At 120, the air temperature within the first cylinder 26 is evaluated. If the temperature of the air within the first cylinder 26 is greater than the ambient temperature by a threshold (e.g., 30 degrees Celsius), the method 110 proceeds to 122. Otherwise, the method 110 terminates.

At 122, the piston position module 48 determines the stopping position of the piston 16 within the first cylinder 26. At 124, the fuel enrichment module 54 determines a first fuel quantity. The first fuel quantity may be determined based on the temperature and volume of the air within the first cylinder 26. The fuel enrichment module 54 receives the temperature of the air within the cylinder from the temperature module 52 and the volume of air within the cylinder from the cylinder volume module 50 and inputs these values into a two dimensional table, which outputs a predetermined first fuel quantity for auto-ignition mitigation.

At 128, the fuel control module 56 commands the fuel injector 24 to provide the first fuel quantity to the first cylinder 26 before the subsequent exhaust stroke of the piston 16 in the first cylinder 26. The first fuel quantity may be provided when the piston 16 in the first cylinder 26 is in a position between, for example, 60 degrees of crankshaft rotation before the end of the intake stroke and 60 degrees of crankshaft rotation after the end of the intake stroke. At 132, the ignition module 58 commands the spark plug 22 to ignite the air-fuel mixture at a predetermined time. The method 110 may then terminate.

Engine operation continues after the method 110 terminates. For example, the fuel injectors 24 provide a second fuel quantity to the cylinders 26, 28, 30, 32 for subsequent combustion events (after the first exhaust stroke of the first cylinder 26). The first fuel quantity may be greater than the second fuel quantity. For example, the first fuel quantity may be between 20 and 150 percent greater than the second fuel quantity. The increased fuel provided by the first fuel quantity may generally decrease as the temperature of the air-fuel mixture during the initial engine start increases to mitigate auto-ignition.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An auto-ignition mitigation system comprising:

a piston position module configured to determine a position of a piston within a cylinder when the piston stops during an intake stroke in response to an engine-off event;

a temperature module configured to determine a first temperature of air within the cylinder;

a fuel enrichment module configured to determine a first fuel quantity based on the first temperature and the position of the piston; and a fuel control module configured to, when a period between the engine-off event and an engine-start event is less than a predetermined period, provide the first fuel quantity to the cylinder before a first exhaust stroke of the piston and to, when the period between the engine-off event and the engine-start event is greater than the predetermined period, inhibit provision of the first fuel quantity to the cylinder.

2. The auto-ignition mitigation system of claim 1, further comprising:

a cylinder volume module configured to determine a volume of air within the cylinder after the engine-off event based on the first temperature and the position of the piston within the cylinder when the piston stops during the intake stroke, wherein the fuel control module is configured to determine the first fuel quantity based on the first temperature and the volume.

3. The auto-ignition mitigation system of claim 1, wherein the piston position module is in communication with a bidirectional crankshaft position sensor, and wherein the bidirectional crankshaft position sensor is configured to determine the position of the piston within the cylinder when the piston stops during the intake stroke.

4. The auto-ignition mitigation system of claim 1, wherein an intake valve located in an intake port in communication with the cylinder is in an open position during the engine-off event.

5. The auto-ignition mitigation system of claim 1, wherein the temperature module is configured to determine an ambient air temperature and the fuel control module is configured to provide the first fuel quantity if the first temperature is greater than the ambient air temperature.

6. The auto-ignition mitigation system of claim 1, wherein the fuel control module is configured to begin providing the first fuel quantity when the piston is in a position between 60 degrees of crankshaft rotation before an end of the intake stroke and 60 degrees of crankshaft rotation after the end of the intake stroke.

7. The auto-ignition mitigation system of claim 1, wherein the fuel control module is configured to provide a second fuel quantity to the cylinder after the exhaust stroke, wherein the first fuel quantity is at least 20 percent greater than the second fuel quantity.

8. A method comprising:

determining a position of a piston within a cylinder when the piston stops during an intake stroke in response to an engine-off event;

determining a first temperature of air within the cylinder;

determining a first fuel quantity based on the first temperature and the position of the piston within the cylinder;

when a period between the engine-off event and an engine-start event is less than a predetermined period, providing the first fuel quantity to the cylinder before a first exhaust stroke of the piston; and when the period between the engine-off event and the engine-start event is greater than the predetermined period, inhibiting the providing of the first fuel quantity to the cylinder.

9. The method of claim 8, further comprising:

determining a volume of air within the cylinder after the engine-off event based on the first temperature and the position of the piston within the cylinder when the piston stops during the intake stroke; and determining the first fuel quantity based on the first temperature and the volume.

10. The method of claim 8, wherein the position of the piston within the cylinder when the piston stops during the intake stroke is determined based on a crankshaft position determined by a bidirectional crankshaft position sensor.

11. The method of claim 8, wherein an intake valve located in an intake port in communication with the cylinder is in an open position during the engine-off event.

12. The method of claim 8, further comprising:

determining an ambient air temperature; and providing the first fuel quantity if the first temperature is greater than the ambient air temperature.

13. The method of claim 8, wherein providing the first fuel quantity begins when the piston is in a position between 60 degrees of crankshaft rotation before an end of the intake stroke and 60 degrees of crankshaft rotation after the end of the intake stroke.

14. The method of claim 8, further comprising providing a second fuel quantity to the cylinder after the exhaust stroke, wherein the first fuel quantity is at least 20 percent greater than the second fuel quantity.

* * * * *